United States Patent [19]

Denzer

[11] 4,348,848

[45] Sep. 14, 1982

[54] SEGREGATED SLAB STRUCTURAL PRODUCTS

[76] Inventor: Walter L. Denzer, P.O. Box 12013, Lubbock, Tex. 79452

[21] Appl. No.: 136,383

[22] Filed: Apr. 1, 1980

[51] Int. Cl.[3] ..... E04B 1/02

[52] U.S. Cl. ..... 52/432; 52/479

[58] Field of Search ..... 52/432, 479, 650, 633, 52/334

[56] References Cited

U.S. PATENT DOCUMENTS

| | | | |
|---|---|---|---|
| 1,955,584 | 4/1934 | Henderson | 52/479 X |
| 2,851,740 | 9/1958 | Baker | 52/479 |
| 3,818,083 | 6/1974 | Butts et al. | 52/334 X |
| 4,056,907 | 11/1977 | Dolder | 52/479 X |

*Primary Examiner*—J. Karl Bell

*Attorney, Agent, or Firm*—Ely Silverman

[57] ABSTRACT

The invention herein is drawn to a plurality of structural products comprising segregated slabs, a process of making such structural products, and apparatus for performing such process of making such products and structures incorporating such products.

The product comprises a plurality of slabs connected to each other only by an array of steel bar members extending therebetween and firmly attached thereto, whereby the slabs are movable relative to each other in directions transverse to the length of said bar members to the limit of flexibility of said steel bar members, so that many undesirable yet usually developed stresses and strains and failures developed in conventional reinforced concrete structures are obviated, and a light, strong, low-cost, thermal insulating structure is provided.

The process of manufacture of the segregated slab product provides for rapid reliable low-cost manufacture of the structures shown and utilizes the spaces provided in the structures made for location and operation of mold forming apparatuses.

The static structures incorporating the segregated slab products minimize the effect of thermal stress and strains on the separate concrete-containing components thereof.

6 Claims, 21 Drawing Figures

SEGREGATED SLAB STRUCTURAL PRODUCTS

BACKGROUND OF THE INVENTION

1. Field of the Invention

The fields of invention to which this invention pertains are static structures and molds therefor.

2. Description of the Prior Art

The prior art of composite concrete structures has utilized spaced apart slabs of concrete, but such masses have not been free of other masses of concrete joined to the spaced apart concrete masses such as in U.S. Pat. Nos. 3,932,082; 1,828,907; and 847,454 with a resultant lack of freedom of movement of the spaced apart masses of concrete and resultant development of strains and stresses due to change in dimensions of the concrete during curing as well as due to temperature differentials during use. Also minimum concrete covering of steel is common practice and direct exposure of steel to spaces between concrete masses is deplored by authorities in the field.

SUMMARY OF THE INVENTION

Composite structures of segregated slabs joined only by steel members in interslab spaces provide for relief of strain and avoidance of stresses as might usually cause concrete cracks and failures as well providing a lightweight product, low in cost of manufacture and installation and with excellent thermal properties in use. A process and interim support apparatus to make the composite structure and utilizing the space between the concrete masses to locate such interim support apparatus is provided and structures utilizing the product, particularly for its thermal properties as well as light weight are developed.

DESCRIPTION OF THE PREFERRED EMBODIMENT

Figure 1:
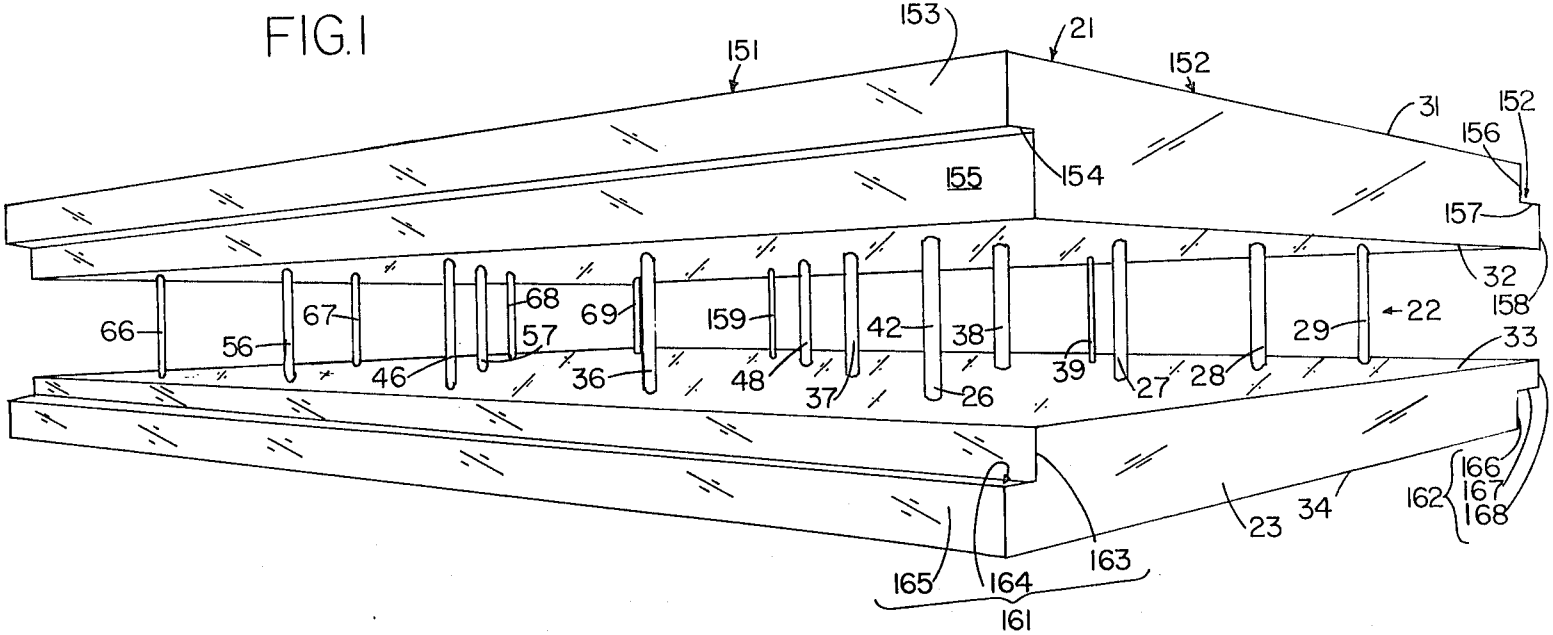
FIG. 1 is a perspective view of an assembly of slabs and bars formed according to this invention.

The description is set out under the following headings: (A) The segregated slab product; (B) apparatus for forming the segregated slab product; (C) process of formation of the segregated slab product; (D) structures incorporating the products.

A. The segregated slab product 20 is an assembly of slabs comprising a first rigid slab 21 comprising concrete and reinforcing steel, a second rigid slab 23 comprising concrete and reinforcing steel, a space 22 therebetween, and an array 25 of steel bar members. The first and second slabs are spaced away from each other. The first slab extends between a first plane 31 and a second plane 32, said first and second planes parallel to each other, and the space 38 between said first and second planes is occupied by the rigid material, comprising concrete and steel forming the slab 21.

Figure 12:
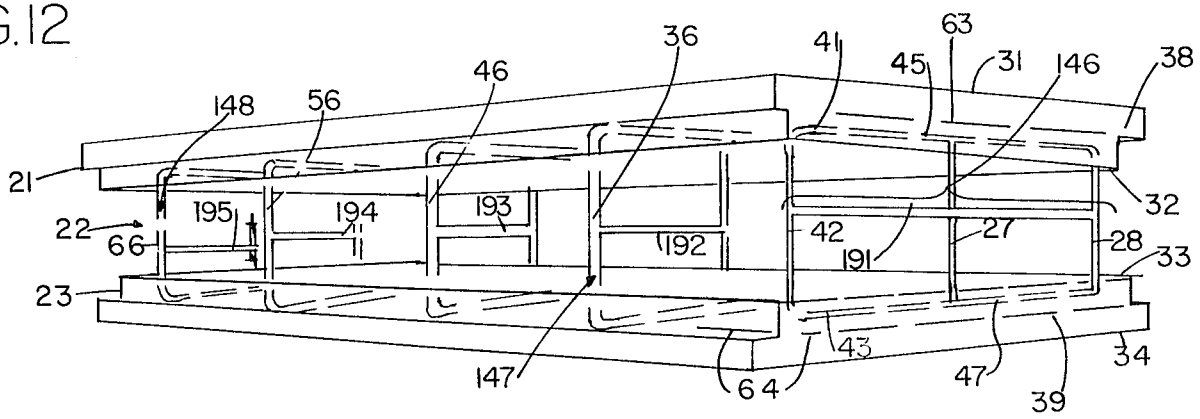
FIG. 12 is a phantom view showing internal structure of a modification of the assembly shown in FIG. 1.

The second slab extends between a third plane 33 and a fourth plane 34 the third and fourth planes are parallel to each other and spaced away from each other. The space 39 between said third and fourth planes is occupied by the rigid material comprising concrete and reinforcing steel forming the slab 23 as shown in FIG. 1 and 12. The first and fourth planes 31 and 37 are spaced apart from each other and parallel to each other and the second and third planes 32 and 33 are located between the first and fourth planes 31 and 34, with the second plane 32 located between the third and first planes 31 and 33 and the third plane 33 located between the second and fourth planes 32 and 34.

The second and third planes 32 and 33 are spaced apart from each other by an interslab space, 22 and a systematic array 25 of like steel bar members shown as 26–29, 36–38, 46, 48, 56, 57 and 66–69 in FIG. 1 extends from the slab material of top slab 21 (between the third and fourth planes) to the slab material of bottom slab 23 (between said first and second planes).

Each of the steel bar members, as 26–29 and 36–38, 46, 48, 56, 57, and 66–69 of the array has an upper imbedded portion 41 imbedded in the first, upper (as shown in FIG. 1), slab and firmly attached thereto, a lower imbedded portion 42 imbedded in the second, lower, slab and firmly attached thereto, and (c) an intermediate portion 42 located between the second and third planes and directly exposed to the space 22 between the slabs 21 and 23, as shown for bar member 26 in FIG. 12.

Figure 2:
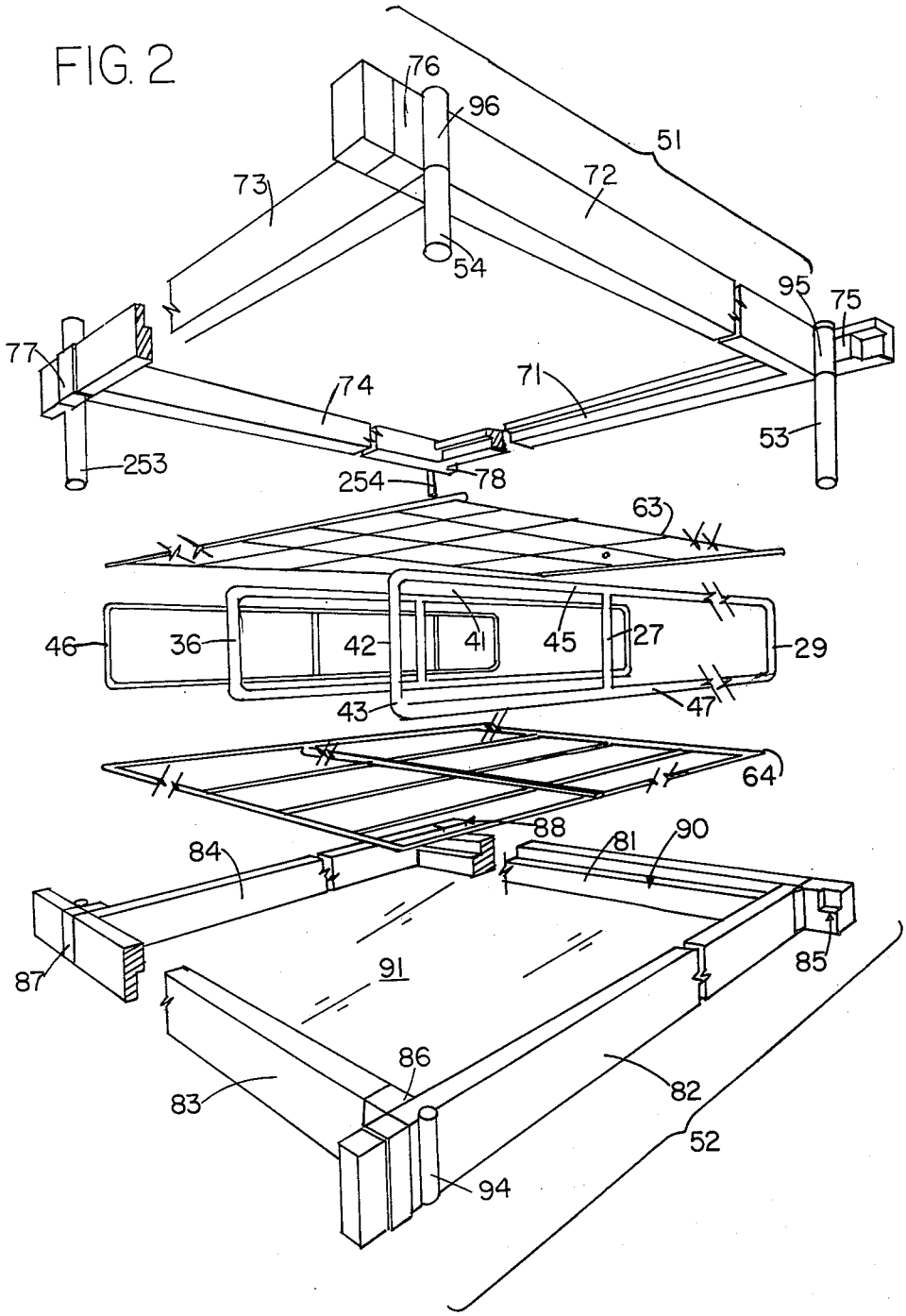
FIG. 2 is an exploded perspective view of a set of components prior to assembly used to form an assembly as in FIG. 1.

As shown in FIG. 1 the opposite edges of the upper and lower slabs 21 and 23 have stepped and portions. Thus, one edge 151 of the upper slab 21 has a vertical flat end portion 153 that extends only a portion of the total height or thickness of that slab 21; that portion, 153, is continuous with a middle horizontal extending flat portion, 154, and that horizontal end portion, 154 is continuous with the lower (as shown in FIG. 1) end or edge portion 155. The edge 152 opposite to edge 151 of the upper slab 21 has a vertical flat end portion 156 that extends only a portion of the total height or thickness of that slab 23, that portion, 151, is continuous with a middle horizontal extending flat portion, 157, and that horizontal end or edge portion, 157 is continuous with lower (as shown in FIG. 1) end portion 158. The opposite edges of the lower slab 23 have stepped end portions. Thus, one edge 161 of the slab 23 has a vertical flat end portion 163 that extends only a portion of the total height or thickness of that slab 23; that portion, 163, is continuous with a middle horizontal extending flat portion, 164, and that horizontal end or edge portion, 164, is continuous with lower (as shown in FIG. 1) end portion 156. The edge 162 opposite 161 on the lower slab 23 has an upper flat end portion 166 that extends only a portion of the total height or thickness of that slab 23; that portion, 166, is continuous with a middle horizontal extending flat portion, 167, and that horizontal end portion, 167 is continuous with upper (as shown in FIG. 1) end portion 168. Portions 156, 158, 165, 166 and 168 are vertical. Each of the bar members of array 25 as 26–29 is arrayed in one of several different straight rows or lines, as row 146, and all the other members of array 25 are also arrayed in other rows, as row 147 for members 46–48 and row 148 for members as 66–69. These rows are parallel to each other and spaced apart from each other by the same distance measured in direction transverse to the length of each row. Each of the bar members in a line, or row as 26, 27, 28 and 29, part of which are shown in FIG. 1, may be held firmly together and in line by rigid straight horizontally extending end pieces as 45 and 47. The imbedded end pieces 45 and 47 are rigid rods and maintain the rigid members of the row of members as 26–29 in line during assembly to form the apparatus as 20 and also provide for bonding of the members 26–29 to the concrete and also provide bearing or support surface for the members as 26–29 in masses 21 and 23 when the concrete in such masses has set. Such portions have bends depending on thickness of the bar used, (such as set out in Table 10 of Dunham "Theory and Practice of Reinforced Concrete" McGraw Hill, 4th Edition, p. 608) to avoid undesirable stresses in the steel. Such portions 45 and 47 are located in the mass of concrete while forming the slabs 21 and 23 and on completion of the casting process are firmly imbedded therein. Heavy steel wire mesh mats as 63 and 64 (as in ASTM designations A-184 and A-185) are also provided for similarly imbedding the concrete masses 21 and 23 respectively. The members 45 and 47 and also the mats 63 and 64 as shown in FIG. 2 reinforce the mass of concrete in which imbedded.

The array 25 of bars is formed of a plurality of rigid members, as bars 26–29, 36, 46 and 56 as shown in FIG. 1 each of which bars extends from within the first lower 23 slab, through the inter slab space 23 to within the second slab 21. The imbedded portion of each bar member, as portion 41 of bar member 36 (FIG. 11) extends parallel to the first and second planes 31 and 32 although the spacer portion 42 of each bar member, as 26 extends transversely to the planes 31, 32, 33 and 34 and the imbedded portion 43 of each bar member as 26 extends parallel to the third and fourth planes 33 and 34.

The depth of immersion of each of the bend portions 41 and 43 of each of the bar member into the respective slab to in which imbedded, as 21 and 23 respectively is adequate for bonding of such member to the slabs 21 and 32 respectively. The length of bar needed to provide adequate anchorage is set out in codes and also at page 591, Table 4, of "Theory and Practice of Reinforced Concrete" McGraw Hill, 4th Edition, 1966, by C. W. Dunham.

Also the total cross sectional area of the totality of the bent portions, as 41 and 43 of array 25 parallel to the planes 31–34 is adequate to avoid exceeding the compressive strength of the concrete to which attached in view of the stresses to which those bars are to be subjected. While such dimensions will vary such calculations are well within the ability of the designer of usual skill and expressed in formulae provided by standard civil engineering textbooks; for example formulae expressed in the Hewlett Packard text entitled "Hewlett Packard HP 41C. Users' Library Solutions, Civil Enginnering" catalogue No. 00041-90089 (give provision for programming such calculation) and also is available to determine for loads on structural steel columns using the American Institute of Steel Construction Formula (1961) whereby the allowable column load (from formula (I) herebelow is readily determined for structures of different sizes and varied loads, also the required moment of inertia (from formula II herebelow) (in view of that the vertical column portions as 42 are firmly held by the portions 42 and 43 imbedded in the slabs as 21 and 23) is also readily determined.

$$P_{allow} = A\,D_y[1 - (L/k)^2/2\,C^2]/m \text{ for } L/k < C \qquad \text{I.}$$
$$P_{allow} = A(1.0273 \times 10^{12}\,N/m^2)/(L/k)^2 \text{ for } C < L/k \leqq 200$$
$$C^2 = 2\pi^2 E/D_y$$
$$m = 5/3 \times 3(L/k)/8C - [(L/k)/2C]^3$$
$$P_{max} = P_{allow}\,m$$

Definitions:

$P_{allow}$ is the allowable load;

$P_{max}$ is the maximum load the column could carry;

A is the area of the section;

L is the length of the column;

k is the minimum radius of gyration of the column cross section;

I is the minimum moment of inertia of the cross section;

$D_y$ is the yield point of the steel;

E is the modulus of elasticity of steel.

II. The amount or section area of rods as 42 needed to provide the moment of inertia to resist compressive buckling would be no greater than (a) $P = \pi^2 EI/4L^2$ where P is the critical buckling load; E is the modulus of elasticity; I is the minimum moment of inertia; and L is the length of the member 42.

A horizontally (in FIG. 12) extending rigid steel rod member as 191 is attached to each of the vertically extending bar members 26–28 in the same row as in row 146, and like transverse rod members as 192–195 are attached to the vertical members in space 42 in all of the other like and parallel rows, as row 146, 147 and 148, respectively of array 25. Such transverse members serve to transfer stresses of displacement of each, as 27, those bar members transverse to their length to adjacent bar members, as 26 and 28, and so resist displacement for a given volume and weight of such vertical members and so provide more strength to resist compression transverse to the length of the slabs as 21 and 23 for a given weight or cross section of steel bars as 26–28.

B. The apparatus 20 is formed by manipulation of concrete in liquid form, reinforcing bars, and the array of bar members 25 using a mold assembly, 50, and a plurality of slab mass spacing and support units as 58 and 59.

The mold assembly 50 comprises a plurality of mold frames assemblies as 51 and 52, and mold frame spacers as 53 and 54, the spacers as 53 and 54 are rigid bars that support the mold frames in a spaced apart relation to each other whereby a mold frame assembly space 55 is provided between the bottom of one, the upper, mold frame assembly 52 and the top of the other, lower, mold frame 52.

Figure 4:
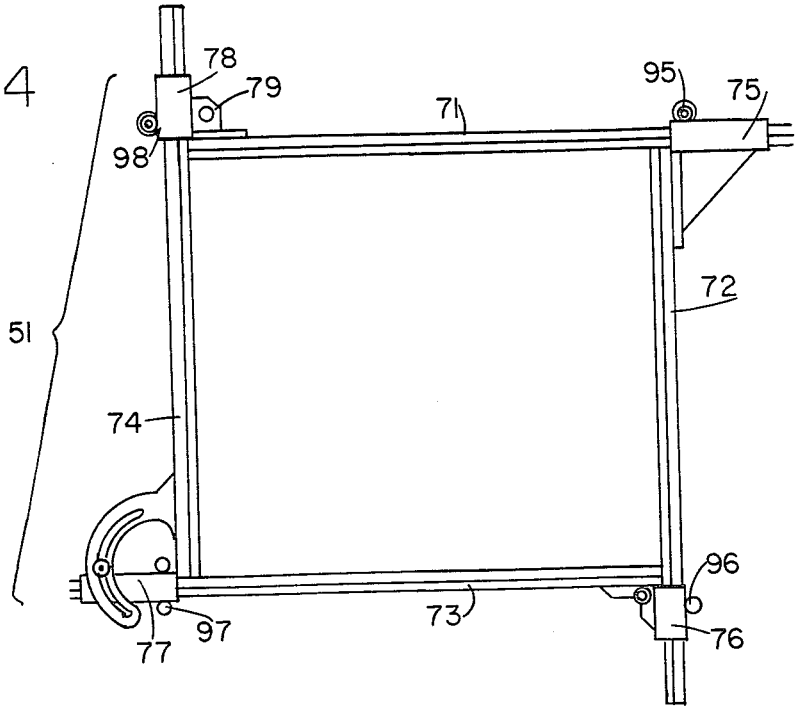
FIG. 4 is a plan view diagrammatically showing a mold assembly used in the formation of the apparatus of FIG. 1.

The upper mold frame assembly, as 51, comprises a series of rigid form walls or boundary plates as 71–74, each of which walls or plates is connected at one end to a slide, as 75–78, respectively, that slides over another mold wall, as shown in FIG. 4; one of the slides, as 78, is connected to an opening latch as 79 that allows the form to be closed for casting or permit separation by opening the form and allowing it to be removed from the casting after the casting is finished. The upper form walls surround the perimeter of the upper casting area, 80, but the top and bottom of the casting area in the upper mold assembly, as 51, are open.

The bottom mold frame assembly as 52, comprises a series of rigid form walls or boundary plates, as 81–84, like 71–74 respectively, and slides as 85–88, like 75–78 respectively, and has an opening latch like 79. The lower form walls surround the perimeter of the lower casting area, 90, and a casting surface or floor member, 91 is located at the bottom of the lower casting area, and firmly yet releasably attached to the walls 81–84.

Figure 3:
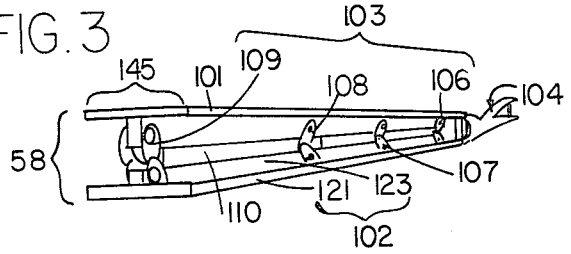
FIG. 3 is a perspective view of a spacer unit used in the formation of the apparatus of FIG. 1.
Figure 5:
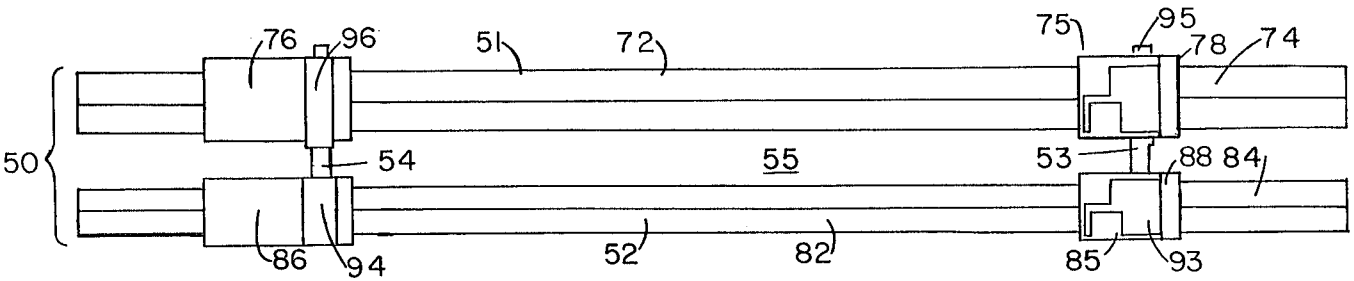
FIG. 5 is a side view of molds during assembly of an apparatus as in FIG. 1 and is diagrammatic.

Each of the slides 75–78 firmly yet releasably holds a vertically extending telescoping connecting bar sleeve, as 95–98 and each of the slides 85–88 similarly holds a sleeve for the telescoping connecting bars, as shown by sleeves 93 and 94 on slides 85 and 86 in FIGS. 2, 3 and 5.

A rigid spacer bar 53 fits into sleeves 93 and 95 and a spacer bar 54 fits into sleeves 94 and 96. Those bars are of uniform transverse cross section and firmly held in those sleeves. Like bars 253 and 254 in sleeves 77 and 78 on the other slides are adjustably yet firmly located in those sleeves, whereby a mold frame space 55 of controlled height is provided between the mold frame assemblies as 51 and 52.

Figure 6:
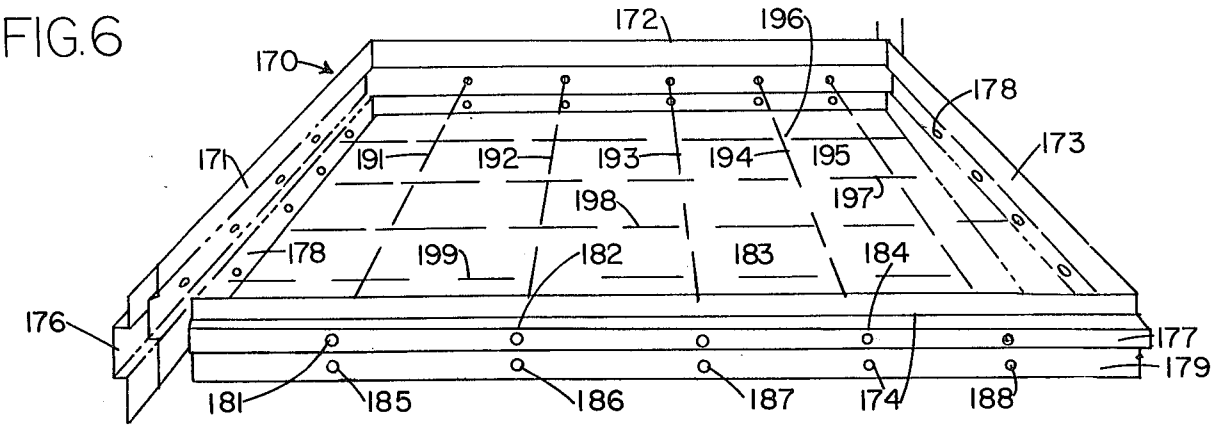
FIG. 6 is a perspective view of a mold used for forming a reinforced steel slab for assembly according to this invention using prestressed wires or rods.

FIG. 6 shows a form 170, generally like 52 for a top slab as 21 and with all four sides thereof, 171–174, provided with outer stepped edge portions as 176 and 177 extending beyond inner edge portions as 178 and 179 on all adjacent form sides as well as for forming stepped edges on opposite sides only as shown in FIGS. 1 and 2. Such form 170 is provided with hinged slides as 75–78 provided for form 51 and is also provided with inlet holes as 181–188 that permit that form to hold reinforcing members or prestressed reinforcing members, as 191–199 for incorporation into the concrete mass formed within such mold. A similar mold is provided for a lower slab as 23 the holes as 181–184 provide for bearing reinforcement members or applying tension in reinforcement members located near to the top of the finished slab. Holes 185–188 provide for applying tension to pretensioned members near the bottom of the slab or supporting reinforcement members near the bottom of the finished slab.

The concrete (49) used in forming the slabs as 21 and 23 and other slabs herein disclosed as shown in FIGS. 14, 15, 16 and 20 is a type II (ASTM C-150) with low water-cement ratio, with 4,000 p.s.i. strength at 28 days with $\frac{3}{4}$ inch maximum size aggregate.

Each of the slab mass support and spacing units, as 58 and 59 comprises a first, rigid, upper, casting surface and casting support unit 101, a second, lower, support and bearing surface unit, 102, a set 103 of expansion links, and an expansion link set actuating assembly 104.

Figure 11:
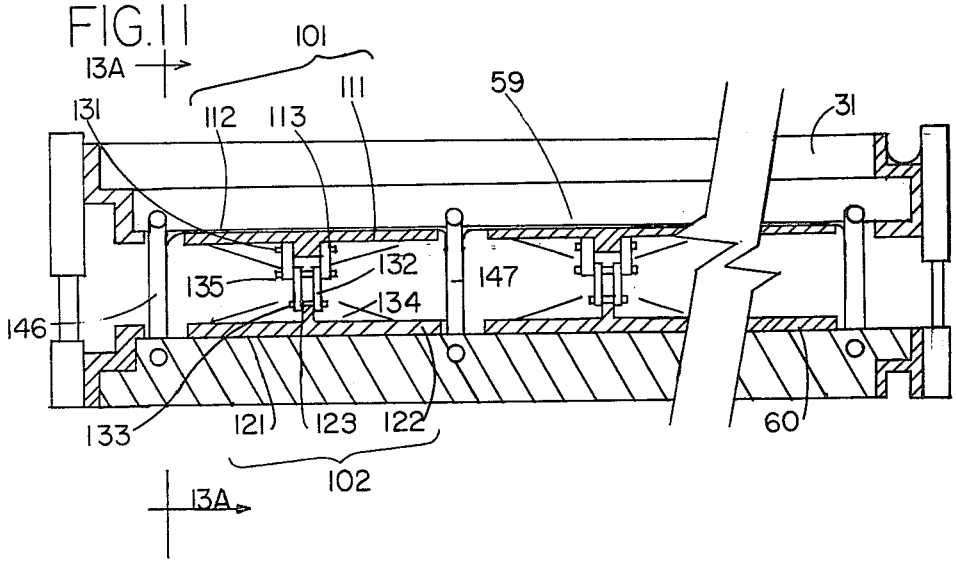
FIG. 11 is a diagrammatic sectional view along plane 11A—11A of FIG. 13 during making of the apparatus 20.

The upper casting surface and surface support unit 101 comprises a rigid steel T-sectioned top plate 111 having a smooth upwardly facing top surface 112 with a rectangular outline and a top plate support flange 113. The plate 111 and plate support flange are firmly joined together as a rigid "T" shaped section with plate on top and support therebelow as shown in FIGS. 3 and 11.

The lower support and bearing surface unit 102 comprises a rigid steel T-sectioned bottom plate 121 having a smooth downwardly facing bottom surface 122 and an upwardly extending guide flange 123 firmly joined together.

The set of links (103) is formed of a plurality of like expansion link sets, as 106, 107, 108 and 109, each of which joins the downwardly extending upper flange and the upwardly extending lower flange of the plates 101 and 102. Each set of expansion links as 107 comprises an upper link, 131, pivotally joined to the upper flange at an upper link pin 132 firmly joined to the upper flange, and a lower link, 133, pivotally joined to the lower flange at a lower link pin, 134, firmly attached to the lower flange. The lower end of the upper link and the upper end of the lower link are pivotally joined at a center link pivot pin 135. The center link pivot pin, as 135, of one set, as 107 and the pin, 136, of another set of links, as 108, attached to the same upper flange and lower flange of the casting surface and support unit, as 58, are joined by a rigid control link, 110. The lower flange 123 is firmly connected to a lower rigid L-shaped control arm 129 and the upper flange 113 is pivotally connected at actuator pin 124 to an upper control arm 119. Actuator links 137 and 138 are like links 131 and 133 in size and between-pin distances and are connected by a pin 139 (like pins 135 and 136). Pin 139 is connected to link 110.

Figure 10:
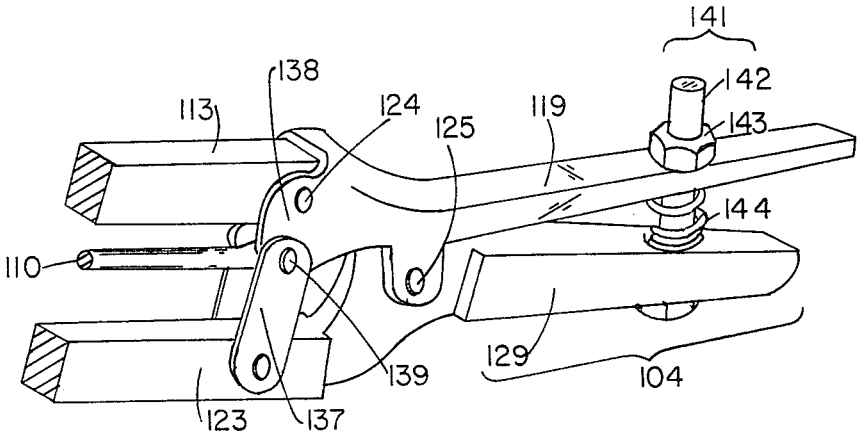
FIG. 10 is a detail view of the assembly 104 shown in FIG. 3 and in FIG. 13.
Figure 13:
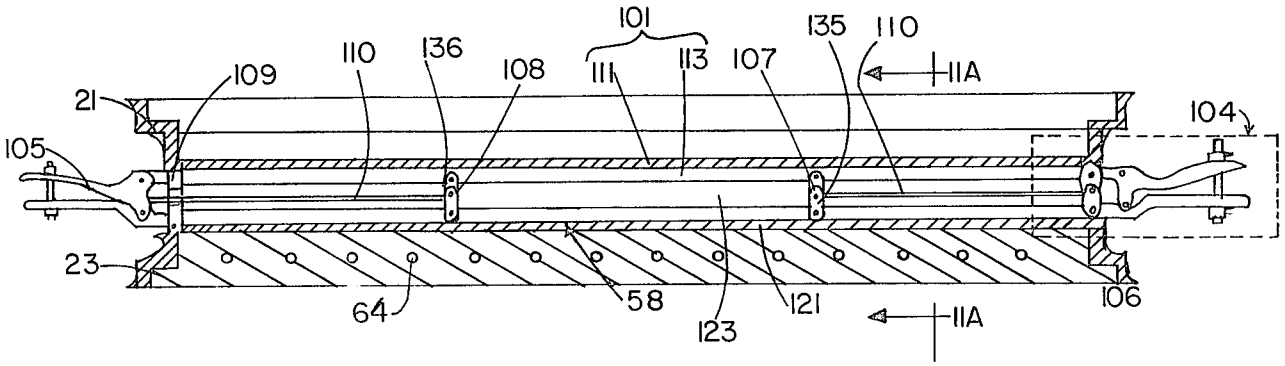
FIG. 13 is a diagrammatic vertical longitudinal section along the section 13A—13A of FIG. 11.

The link set actuating assembly 104 comprises an upper rigid control arm 119, a lower control arm 129, pivotally connected at pin 125, and an adjustable arm operator 131 as shown in FIG. 10; the operator 131 comprises a sturdy threaded bolt 142 and nut 143 and spring 144; the bolt is firmly yet slidably located in the holes or journals therefor in the arms 119 and 129. A pivot pin 124 is held both in arm 119 and flange 113. Arm 129 is firmly fixed to flange 123. A long-armed wrench applied to the nut 143 and turning the nut on the bolt 142 in one direction provides for adjustably raising the upper casting surface and support unit 101 relative to the lower support unit 102 while parallel thereto: turning the nut 143 in the opposite direction provides for adjustably lowering the upper casting surface relative to the lower unit 102 while the upper surfaces and lower surfaces of units 101 and 102, respectively, are parallel to each other. There may be a like link actuating assembly 105, (like actuating assembly 104), at each ends of all units as 58. Also there may be more than two like sets of links such as link sets as 106 and 107, as shown in FIGS. 3 and 13.

Figure 9:
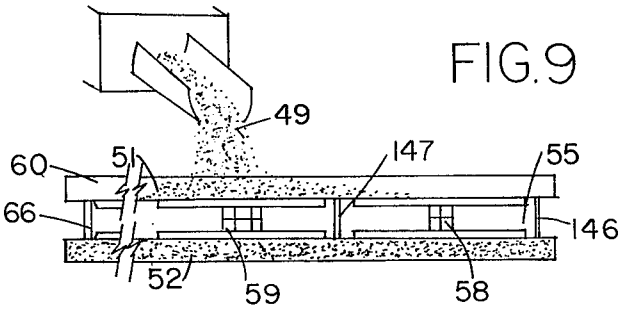

FIG. 1 is drawn in perspective to diagrammatically illustrate the rectilinear arrangement of straight line array of the vertical portions, as 42, of the rows of bar members, as 26–29, 36–39, 46, 48, 56, 57, 159 and 66–69. One of the rows is indicated in FIGS. 9 and 11 and 12 by referent number 146 and 147. The diameter or thickness of the bars as 26–29 and their spacing along the rows is chosen to provide, in view of the compressive strength of the concrete used and usual safety factor adequate cross-sectional area to resist compressive stress applied to the finished assembly 20.

The length of the slab mass spacer and support units as 58 and 59 (and other as 60 used to form assemblies as 20) is great relative to their width as 145 and the upper surface thereof, as 112, is rectangular in shape so as to fit readily in the space between the rows as 146 and 147 of vertical portions as 42 of the bar members, 26–29 and 36–39 and 46–49 in the interslab space as 22. The ready reduction of the height of the upper surface, as 112, of the slab mass spacer and support units as 58 by adjustment of the actuating assemblies as 104 provides for ready removal of the units as unit 58 and 59 after the mass of concrete and reinforcement, as 21, has set.

Figure 8:
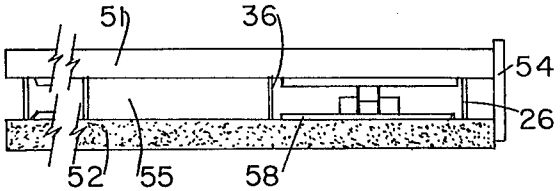
FIGS. 7, 8 and 9 show steps in the formation of an apparatus according to this invention as shown in FIG. 1.

C. The process for forming an overall rigid composite segregated slab product as 20 is illustrated diagrammatically in FIGS. 7–9 comprises the steps of (a) pouring a first mass of concrete in a mold as 52 in the form of a first flat slab as 23 having a width and length very much larger than its thickness and then (b) forming a floor above and spaced by space as 55 from the top of the first slab while (c) supporting a rigid array of bars as array 25, in which array each of the bars extend vertically from within the first lower mass 23 to above the floor surface formed by the top surfaces, as 112, of each of the slab mass support and spacing units, as 58, of a large member of such like units, as 58, 59 and 60 (as shown in FIG. 9), then (d) pouring a second concrete mass as shown in FIG. 9 on said floor to form a second slab, as 21 and so attaching one lower end as 43 of each of the bars of the array of bars, as bar 26, to one of said slabs as 23 in which imbedded and another, upper end as 43 of each of such bars as 26 to the other of said slabs as 21.

Figure 14:
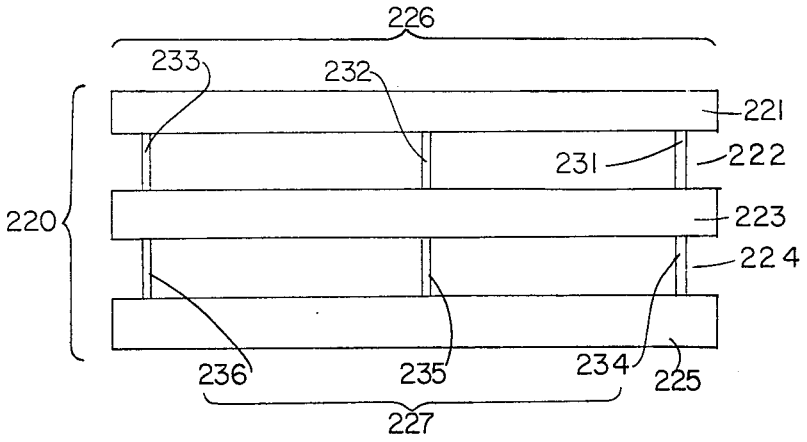
FIG. 14 is an end view along the direction of the arrow 14A of another embodiment of apparatus, shown in FIG. 15.
Figure 15:
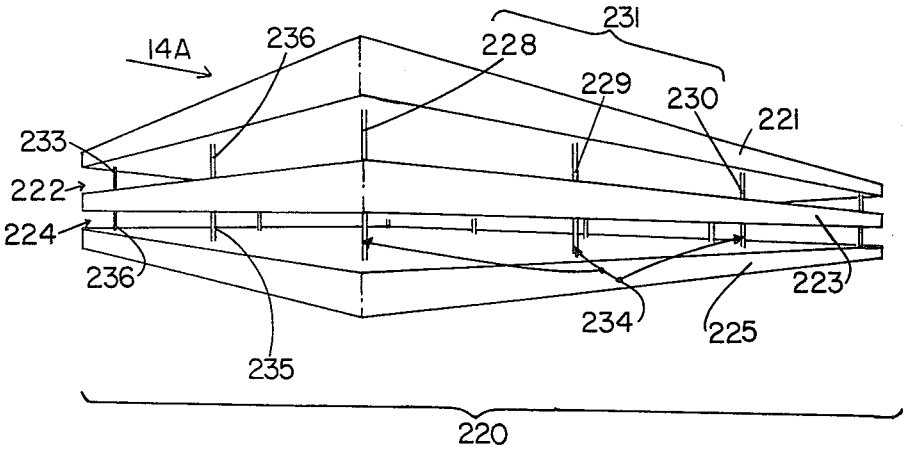
FIG. 15 is a perspective view of the apparatus shown in FIG. 14.

D. In FIGS. 14 and 15 another segregated slab embodiment, 220 is shown. Embodiment 220 is formed of an upper slab 221, a middle slab 223, and a lower slab 224, with an upper interslab space 222 between slabs 221 and 223 and a lower interslab space 224 between slabs 223 and 225. The slabs 221, 223 and 225 are firmly held in position relative to each other by rod arrays 226 and 227; each rod array 225 and 227 is composed of an array of steel bars like array 25 in embodiment 20 shown in FIG. 1. The array 225 is composed of rigid like straight lines or rows, as 231, and 233 of bar members as 228, 229, and 230 in row 231. Each member, as 221 is like member 26 in row embodiment 20 and each row 231, 232, 233 is like the rows 146, 147 and 48 in embodiment 20. Array 227 is composed of several like rows as 234, 235, 236, each like rows 231, 232, and 233 respectively. Rows 231 and 234 are co-planar and rows 232 and 235 are coplanar a and rows 233 and 236 are coplanar b. The flexibility of the bar members permits movement of slab 223 relative to slab 221 and the flexibility of array 227 permits movement of slab 225 relative to slab 223 and 221 in the same member as the lower slab 23 is movable relative to slab 21 in embodiment 20; however, the reduction of length of column of each rod member as 228, 229 and 230 from top slab to bottom slab permits a lesser weight of steel than where one column, as 26 uninterrutedly reaches from the top slab to the bottom slab of a segregated slab structure. The slabs 221, 223 and 225 are formed in the same manner as are slabs 21 and 27 in apparatus 20.

Figure 16:
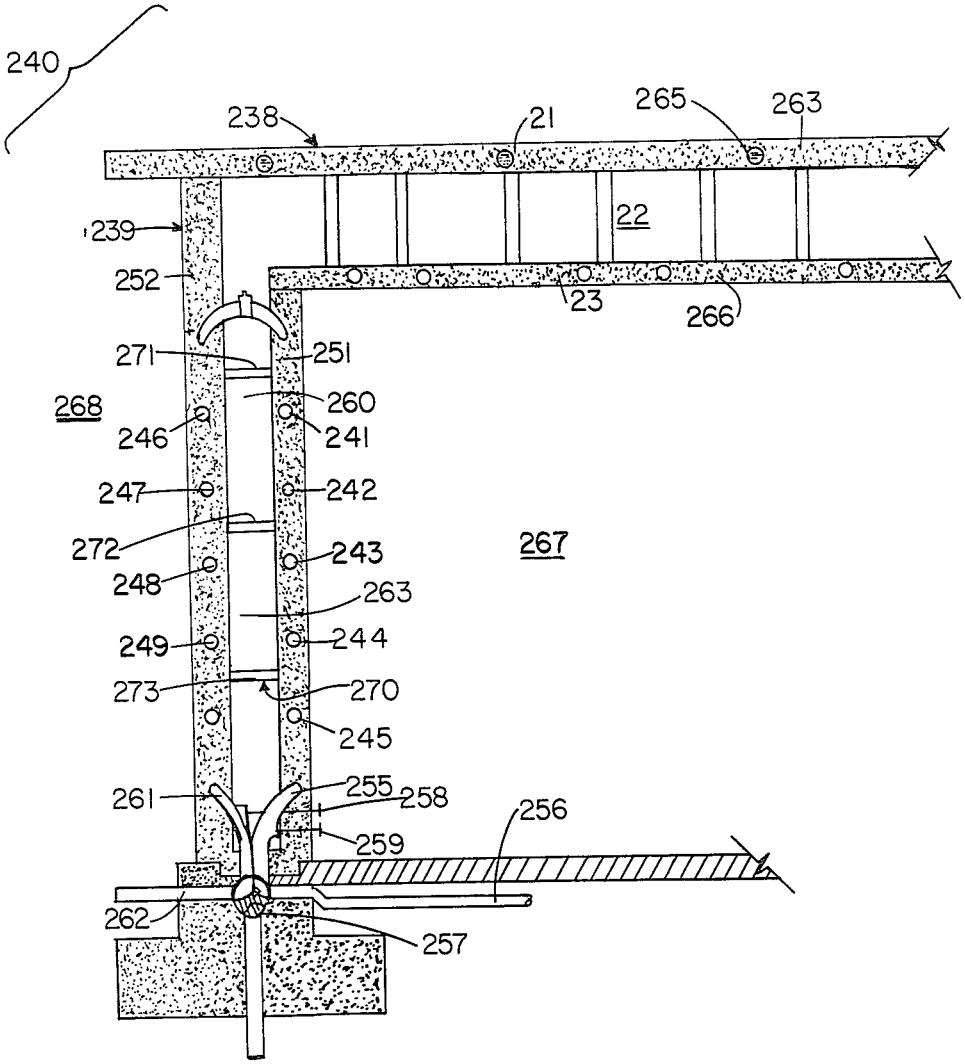
FIG. 16 is a diagrammatic vertical transverse sectional view showing another embodiment of apparatus in a portion of a completed structure.

FIG. 16 shows a portion of a building structure 240 comprising a vertically elongated segregated slab structure 238 and a horizontally extending segregated slab structure 239. The slab 238 comprises vertically extending spaced apart slabs 251 and 252 and an interslab space 26. The structure 240 incorporates not only segregates slab structures as in FIGS. 1 (at 238) and 17 (at 239) but also fluid carrying conduits 241 in the inner wall 251 and conduits 246–249 in the outer wall 252 for carrying heating and/or cooling fluids. Those conduits are incorporated in the molds when the slabs as 251 and 252 are formed in same manner as slabs 21 and 23 are formed. The slabs 251 and 252 have the same structure as slabs 21 and 23 and the interslab space 260 is like interslab space 22 but the length and width of slabs 251 and 252 and interslab space 260 extend vertically.

The rows of rod members as 271, 272, and 273 in the interslab space 260 are formed in an array 270 of rod members which array is structurally and functionally like the array 25 of rod members in embodiment 20. The relations of the slabs 251, and 252 and interslab space 260 and array of rod members 270 is the same as in embodiment 20 structurally and functionally.

A fluid conduit 262 for the line 261 to the exterior series of fluid conduits 246–249 in wall or slab 252 passes via a directional or selection control valve 257 and a volume control valve 258. A fluid inlet line 256 to the line 255 passing to the series of conduits 241–245 in wall or slab 251 also passes to those conduits by way of the direction control valve 257 and a separate volume control valve 259. The conduits as 244–249 are located in the molds, as 51 and 52 for the slabs, as 251 and 252. The thermal expansion and contractions of the walls due to the temperature of the fluid in the conduits does not cause localized strain on the web portions because the metal as array 270 are capable of displacement to an S-shape on expansion of one or the other of the walls as 251 and 252.

The conduits as 246–249 in the outer wall or slab serve to pass liquid heated by a heat source, as by roof panel solar energy which water is not hot enough to provide an ambient air temperature comfortable to humans in the interior room as 267 enclosed by the interior walls 251, but is adequate to so affect the temperature differential between the inner and outer walls 251 and 252 and so reduce the heat loss from the interior wall 251 and enclosed space 267 to the exterior wall and the outer space 268 adjacent the outer wall. The conduits 241–245 in the inner wall are useful for passing cooled liquid, as from and evaporative air conditioner, to the walls of the house adjacent a room for habitation without development of undesirable amount of humidity.

Figure 17:
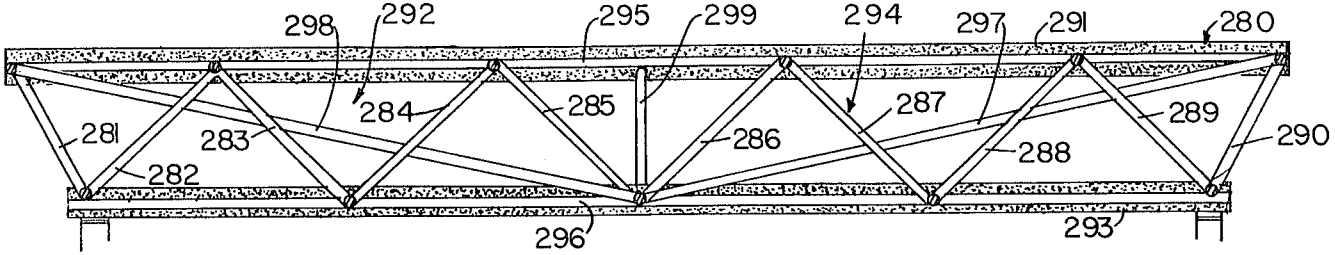
FIG. 17 is a diagrammatic vertical transverse sectional view of another embodiment of apparatus according to this invention.

FIG. 17 shows an embodiment 280, wherein reinforced concrete slabs 291 and 293, each formed similarly to slabs 21 and 23, are spaced apart by an interslab space 292 wherein an array 294 of rod members is located; such rod members are steel reinforcing rods as in embodiment 20, and are arrayed in rows so that all rod members as 281–290 are that extend in one of several vertical planes such as 146, 147 or 148. The slabs 292 and 293 are each provided with matts of reinforcing steel, 295 and 296 respectively like mats 63 and 64 in embodiment 20. The matts 295 and 296 are joined so the reinforcing bars by wire or by welding; and the matts 63 and 64 may be similarly joined to the reinforcing rod members of the array 25 in embodiment 20.

The rod members 281–290, in the embodiment 280 shown in FIG. 17 are arrayed in non vertical orientation relation to the horizontally extending slabs 292 and 293. Such orientation of those rod members allows the spacer and support units as 58 to be passed between molds when such segregated slab units as 292 and 293 as shown in FIG. 17 are formed. Diagonal steel tension bearing members as 297 and 298 in the upper and lower slabs 291 and 293 may be used, together with a compression member 299, to further increase the strength of the composite structure 280.

Figure 21:
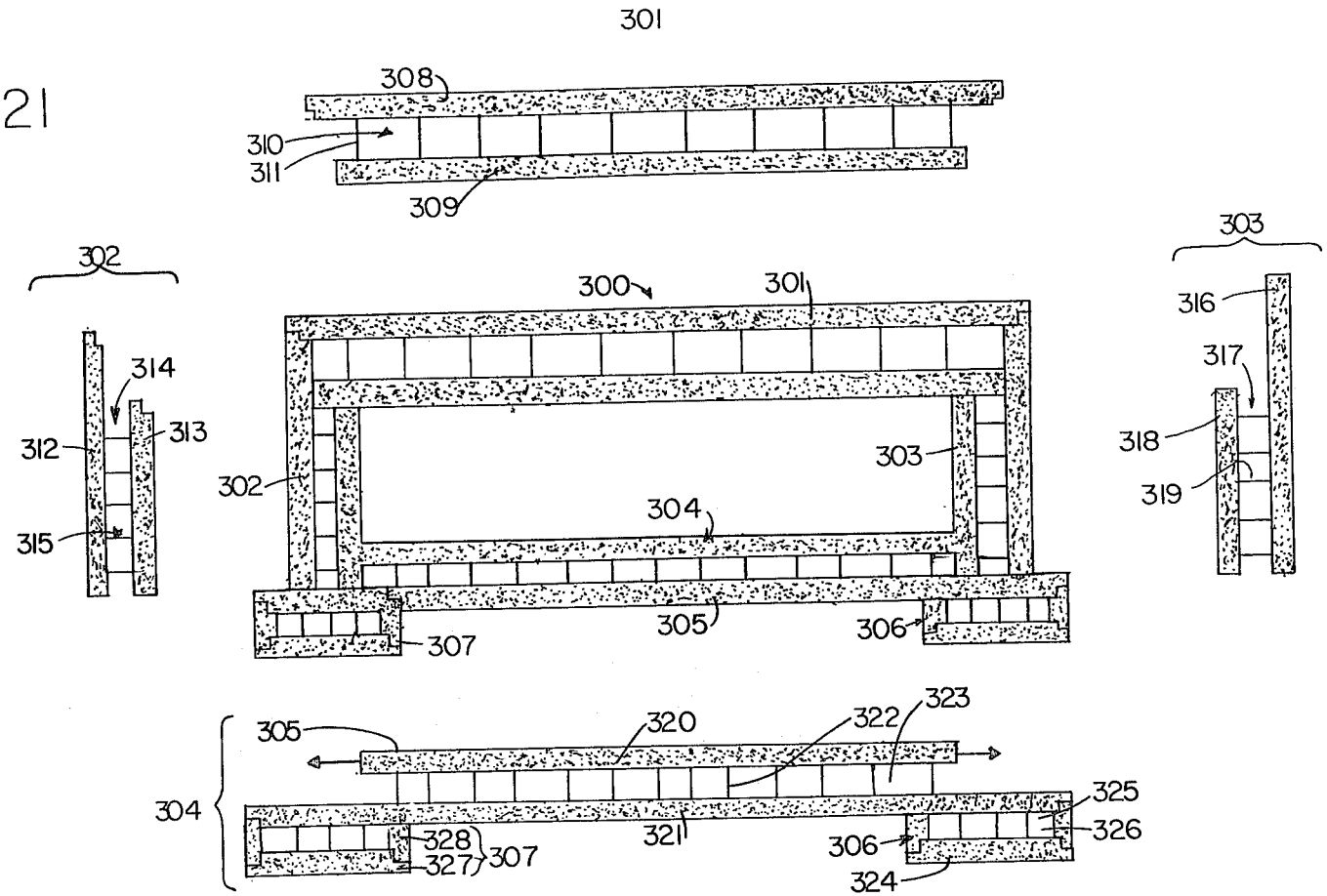
FIG. 21 is a composite view showing a vertical section view of a building structure with components as shown in FIGS. 1, 16, and 20.

A composite segregated slab building unit 300 of FIG. 21 comprises a segregated slab roof structure unit 301, a left wall structure unit 302, a right wall structure unit 303 and a floor and foundation structure unit 304.

It is shown in assembled condition and in exploded view in FIG. 21 to show the relations of its parts more clearly, with the assembled array in the center of the figure and the units 301, 302, 303 and 304 thereof circumferentially thereof and spaced apart from the assembled view.

The roof structure unit is formed of upper slab 308 like slab 21 of embodiment 20 and lower slab 309 like slab 23 separated by interslab space 310, like interslab 22 with an array of rod members 311 (like array 25 in embodiment 20) in the interslab space and connected to the slabs 308 and 309 in the same manner as array 25 is connected to slabs 21 and 23 in embodiment 20.

The wall structure unit 302 is formed of an outer slab 312, and inner slab 313 and interslab space 315 (like slab 21, slab 23 and interslab space 22 respectively in embodiment 20) with the slabs connected by an array or rod members 314 like the array 25 in embodiment 20.

The wall structure unit 303 is formed of an outer slab 316, and an inner slab 318, with an interslab space 317 (like slabs 21, 23 and interslab space 22 respectively in embodiment 20) with the slabs 316 and connected by an array of rod members 319 like the array 25 in embodiment 20.

The base and foundation member 304 is composed of a floor unit 305 and two foundation members 306 and 307. The slabs 320, 321, 324 and 327 have the same structure as the slabs 21 and 23 of embodiment 20.

The floor structure unit 305 is formed of upper slab 320 like slab 21 of embodiment 20 and lower slab 321 like slab 23 separated by interslab space 323 like interslab space 22 with an array of rod members 322 (like array 25 in embodiment 20) in the interslab space and connected to the slabs 320 and 321 in the same manner as array 25 is connected to slabs 21 and 23 in embodiment 20.

The foundation structure unit 307 is formed of an outer portion of lower slab 321 and lower slab 324 and interslab space 326 (like slab 21, portion of slab 23 and interslab space 22 respectively in embodiment 20) with the slabs 324 and 321 connected by an array or rod members 325 like the array 25 in embodiment 20.

The foundation structure unit 307 is formed of an outer portion of lower slab 321 and a lower slab 327 with an inter slab space 328 (like slabs 21, a portion of slab 23 and interslab space 22 respectively in embodiment 20) with the slabs 327 and 321 connected by an array of rod members 328 like the array 25 in embodiment 20.

Unit 304 is a composite of embodiment unit 20 and the three-slab structure of embodiment 220 and the portions 307 and 308 separately like embodiment 20 but smaller than unit 305.

The structure 304 is particularly stable against cracking and is low in cost of construction and has the thermal advantages above described.

Figure 7:
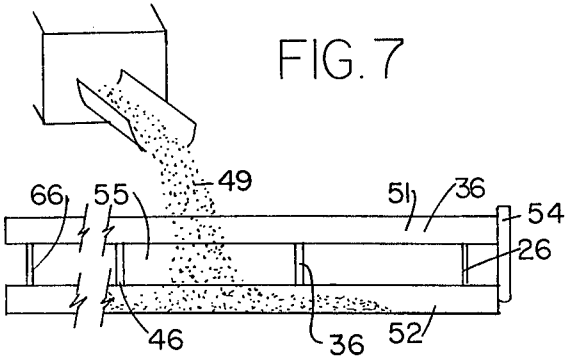

The segregated structure of FIGS. 1 and 7 show a stepped structure at the ends. Such steps provide that the weight of the segregated slab is supported at its top slab and bottom slab member 23 may move relative to the top slab member 21 in a direction parallel to the plane of the length and/or width or the top member and so relieve strain that may otherwise be applied thereto when such stress is applied to the lower member as to change its dimensions or position relative to the top member. This movement of the lower member relative to the upper member is accomplished notwithstanding the dimensional stability of the top slab and the support in a vertical direction provided by the bar members of array 25 to the upper member slab 21. Inasmuch as the steel bars as 26–29 are flexible transversely to their length there is allowed a movement of lower slab relative to the upper slab in an amount only limited by the flexibility of the steel bar members in the interslab space. In the case of vertically extending segregated slabs as shown in FIG. 16 is the inner wall may move vertically relative to the outer wall, and vice-versa, rather than the upper and lower walls referred to in describing the actions of the components of the segregated slab structure of FIG. 1 and like apparatuses as in FIGS. 12, 14 and 15 which extend for their length and width in horizontal planes.

Figure 18:
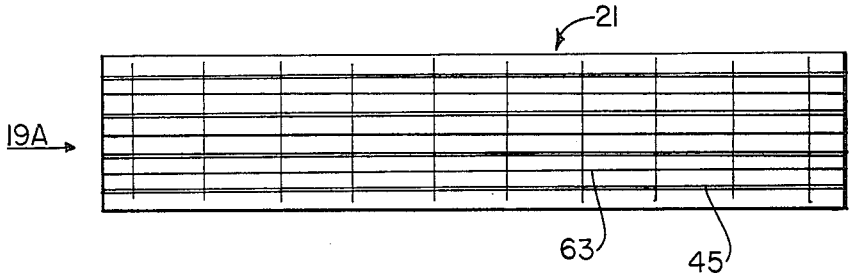
FIG. 18 is a plan view as seen along direction of arrow 18A of FIG. 19 of an embodiment as shown in FIG. 20.
Figure 19:
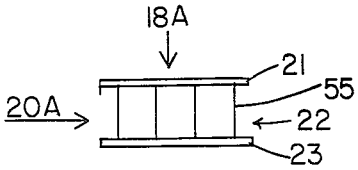
FIG. 19 is an end view of a structure shown in FIGS. 18 and 20 as seen along direction of arrow 19A of FIG. 18.
Figure 20:
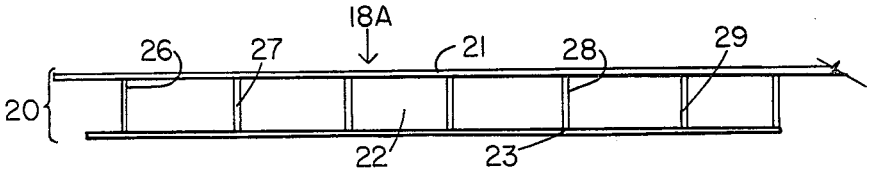
FIG. 20 is a side view of an embodiment of apparatus as seen along direction of arrow 20A of FIG. 19.

In a particular embodiment as shown in FIGS. 18–20, with an assembly as 20 in form of a slab 8 feet long and 8 feet in height, with concrete 5.375 in. thick in slab 21 and 3.675 inches thick in layer 23 and 8 inches interslab space 22 and 0.5 inch of plaster on bottom surface of layer 23, the U value is 0.061 B.T.U./hr.loss. Also, with a segregated slab apparatus as in embodiment 20, and shown in FIGS. 18–20 with FIG. 18 in plan view and concrete shown as transparent to show location of bars of mass 63 and like 47 within the concrete mass such embodiment being thirty feet long, 24 inches in height from top plane of slab 21 to bottom surface of slab 23, with #6 bar mesh running horizontally in each slab and #8 bars extending between the slabs, and 2 feet distance between the planes of the rods made of #8 rod and the the mesh 63 in 1 foot squares and 4 inches thickness of slab 21 and 2 inches for slab 23, provides a bearing strength of 195 lbs. per linear foot with 2 feet between bars as 26–29. The actuator mechanism 104 and 105 of the spacing units 58 and 59 may be hydraulically actuated, instead of mechanically as shown in FIGS. 3, 10 and 11.

I claim:

1. A structural precast structure assembly product comprising a first rigid slab comprising strong concrete and reinforcing steel, a second rigid slab comprising strong concrete and reinforcing steel and an array of steel bar members therebetween;

said first and second slab spaced away from each other, the first slab extending between a first plane and a second plane, said first and second planes parallel to each other, and the space between said first and second planes occupied by a rigid material comprising concrete and steel, the second slab extending between a third plane and a fourth plane and said third and fourth planes parallel to each other and spaced away from each other and the space between said third and fourth planes occupied by a rigid material comprising concrete and reinforcing steel;

said first and fourth planes spaced apart from each other and parallel to each other, said second and third planes located between said first and fourth planes, said second plane located between said third and first planes, said third plane located between said second and fourth planes;

said second and third planes spaced apart from each other by an interslab spaced, rigid steel bar members extending from said material between said third and fourth planes to the material between said first and second planes, each of said steel bar members having one part thereof located between said second and third planes and directly exposed to the interslab space, and another part of each of those steel bar members being firmly and rigidly attached to the material between said first and second planes and another part of each of said steel bar members being firmly and rigidly attached to the material between said third and fourth planes, the length of each of said steel bar members extending between said slabs located in a parallel array of such members in parallel flat planes, said slabs connected to each other only by said steel bar members whereby the slabs are movable relative to each other in two directions transverse to each other and to the length of said steel members to the limit of the flexibility of said steel bar members.

2. A structural precast structure assembly product as in claim 1 comprising a third rigid slab comprising concrete, and a second array of steel bar members therebetween;

said second and third slabs spaced away from each other, the third slab extending between a fifth plane and a sixth plane, said fifth and sixth planes parallel to each other, and the space between said fifth and sixth planes occupied by a rigid material comprising concrete and steel;

said fifth and sixth planes spaced apart from each other and parallel to each other, said fourth and fifth planes located between said third and sixth planes, said fifth plane located between said fourth and sixth planes, said fourth plane located between said third and fifth planes;

said fourth and fifth planes spaced apart from each other by an interslab space, rigid steel bar members extending from said material between said third and fourth planes to the material between said fifth and sixth planes, each of said rigid steel bar members having one part thereof located between said fourth and fifth planes and directly exposed to the interslab space, and another part of each of those steel bar members being firmly attached to the material between said third and fourth planes and another part of each of said steel bar members being firmly attached to the material between said fifth and sixth planes, the length of each of said steel bar members extending between said second and third slabs located in an array of parallel flat planes, said second and third slabs connected to each other by said steel bar members whereby the second and third slabs are movable relative to each other in two directions transverse to each other and to the length of said steel members to the limit of the flexibility of said steel bar members.

3. Apparatus as in claim 1 comprising a plurality of tension bearing means each located between said second and third planes and each firmly connected to two of said steel bars between said second and third planes.

4. Apparatus as in claim 3 wherein said tension bearing means are rigid steel bars.

5. A static structure comprising a roof composed of a segregated slab as in claim 1 wherein said first through fourth planes extend horizontally and a vertical wall comprising a vertically extending structure as in claim 1 wherein said first through fourth planes extend vertically.

6. A structure as described in claim 5 and also comprising a foundation structure comprising a structural precast structure assembly product comprising a first rigid slab comprising strong concrete and reinforcing steel, a second rigid slab comprising strong concrete and reinforcing steel and an array of steel bar members therebetween;

said first and second slab spaced away from each other, the first slab extending between a first plane and a second plane, said first and second planes parallel to each other, and the space between said first and second planes occupied by a rigid material comprising concrete and steel, the second slab extending between a third plane and a fourth plane and said third and fourth planes parallel to each other and spaced away from each other and the space between said third and fourth planes occupied by a rigid material comprising concrete and reinforcing steel;

said first and fourth planes spaced apart from each other and parallel to each other, said second and third planes located between said first and fourth planes, said second plate located between said third and first planes, said third plane located between said second and fourth planes; said second and third planes spaced apart from each other by an interslab space, rigid steel bar member extending from said material between said third and fourth planes to the material between said first and second planes, each of said steel bar members having one part thereof located between said second and third planes and directly exposed to the interslab space, and another part of each of those steel bar members being firmly and rigidly attached to the material between said first and second planes and another part of each of said steel bar members being firmly and rigidly attached to the material between said third and fourth planes, the length of each of said steel bar members extending between said slabs located in an parallel array of such members in parallel flat planes, said slabs connected to each other only by said steel bar members whereby the slabs are movable relative to each other in two directions transverse to each other and to the length of said steel members to the limit of the flexibility of said steel bar members;

said assembly product also comprising a third rigid slab comprising concrete, and a second array of steel bar members therebetween;

said second and third slabs spaced away from each other, the third slab extending between a fifth plane and a sixth plane, said fifth and sixth planes parallel to each other, and the space between said fifth and sixth planes occupied by a rigid material comprising concrete and steel;

said fifth and sixth planes spaced apart from each other and parallel to each other, said fourth and fifth planes located between said third and sixth planes, said fifth plane located between said fourth and sixth planes, said fourth plane located between said third and fifth planes;

said fourth and fifth planes spaced apart from each other by an interslab space, rigid steel bar members extending from said material between said third and fourth planes to the material between said fifth and sixth planes, each of said rigid steel bar members having one part thereof located between said fourth and fifth planes and directly exposed to the interslab space, and another part of each of those steel bar members being firmly attached to the material between said third and fourth planes and another part of each of said steel bar members being firmly attached to the material between said fifth and sixth planes, the length of each of said steel bar members extending between said second and third slabs located in an array of parallel flat planes, said second and third slabs connected to each other by said steel bar members whereby the second and third slabs are movable relative to each other in two directions transverse to each other and to the length of said steel members to the limit of the flexibility of said steel bar members; and said assembly product also comprising a plurality of rigid steel bars each located between said second and third planes and each firmly connected to two of said steel bars between said second and third planes.

* * * * *